US008771482B2

(12) United States Patent
Bailey et al.

(10) Patent No.: US 8,771,482 B2
(45) Date of Patent: Jul. 8, 2014

(54) ANODE SHROUD FOR OFF-GAS CAPTURE AND REMOVAL FROM ELECTROLYTIC OXIDE REDUCTION SYSTEM

(75) Inventors: James L. Bailey, Hinsdale, IL (US); Laurel A. Barnes, Chicago, IL (US); Stanley G. Wiedmeyer, Glen Ellyn, IL (US); Mark A. Williamson, Naperville, IL (US); James L. Willit, Batavia, IL (US)

(73) Assignee: GE-Hitachi Nuclear Energy Americas LLC, Wilmington, NC (US)

( * ) Notice: Subject to any disclaimer, the term of this patent is extended or adjusted under 35 U.S.C. 154(b) by 806 days.

(21) Appl. No.: 12/977,791

(22) Filed: Dec. 23, 2010

(65) Prior Publication Data

US 2012/0160668 A1 Jun. 28, 2012

(51) Int. Cl.
*C25C 7/02* (2006.01)
*C25C 3/34* (2006.01)

(52) U.S. Cl.
USPC ..... 204/297.01; 204/245; 204/275.1

(58) Field of Classification Search
USPC ..... 204/297.01
See application file for complete search history.

(56) References Cited

U.S. PATENT DOCUMENTS

| | | | | |
|---|---|---|---|---|
| 422,139 | A | 2/1890 | Maxon | |
| 2,089,738 | A | 8/1935 | Elmer | |
| 2,194,444 | A * | 3/1940 | Laughlin et al. | 204/247 |
| 2,800,219 | A | 7/1957 | Carroll | |
| 2,913,380 | A | 11/1959 | Gullett | |
| 3,562,131 | A | 2/1971 | Jasberg | |
| 3,645,708 | A | 2/1972 | Grady | |
| 3,697,404 | A | 10/1972 | Paige | |
| 3,972,794 | A * | 8/1976 | Lamm | 204/266 |
| 4,013,329 | A | 3/1977 | Hugin | |

(Continued)

FOREIGN PATENT DOCUMENTS

| | | |
|---|---|---|
| AU | 622994 | 4/1992 |
| CA | 1 142 123 | 3/1983 |

(Continued)

OTHER PUBLICATIONS

International Search Report and Written Opinion issued in International Patent Application No. PCT/US2012/058663, issued Aug. 12, 2013.

(Continued)

*Primary Examiner* — Bryan D. Ripa
(74) *Attorney, Agent, or Firm* — Harness, Dickey & Pierce, P.L.C.

(57) ABSTRACT

An electrolytic oxide reduction system according to a non-limiting embodiment of the present invention may include a plurality of anode assemblies and an anode shroud for each of the anode assemblies. The anode shroud may be used to dilute, cool, and/or remove off-gas from the electrolytic oxide reduction system. The anode shroud may include a body portion having a tapered upper section that includes an apex. The body portion may have an inner wall that defines an off-gas collection cavity. A chimney structure may extend from the apex of the upper section and be connected to the off-gas collection cavity of the body portion. The chimney structure may include an inner tube within an outer tube. Accordingly, a sweep gas/cooling gas may be supplied down the annular space between the inner and outer tubes, while the off-gas may be removed through an exit path defined by the inner tube.

20 Claims, 9 Drawing Sheets

(56) References Cited

U.S. PATENT DOCUMENTS

| | | | |
|---|---|---|---|
| 4,023,673 | A | 5/1977 | Hansen |
| 4,039,403 | A | 8/1977 | Astley et al. |
| 4,073,703 | A | 2/1978 | Kinosz et al. |
| 4,148,392 | A | 4/1979 | Larson et al. |
| 4,203,531 | A | 5/1980 | Reichel et al. |
| 4,326,937 | A | 4/1982 | Neumeier et al. |
| 4,437,968 | A | 3/1984 | Elliott, Jr. |
| 4,492,621 | A | 1/1985 | Stubb |
| 4,668,353 | A | 5/1987 | Smith et al. |
| 4,851,098 | A | 7/1989 | Kimura et al. |
| 4,863,580 | A | 9/1989 | Epner |
| 4,880,506 | A | 11/1989 | Ackerman et al. |
| 4,946,026 | A | 8/1990 | Rickman |
| 5,415,742 | A | 5/1995 | La Camera et al. |
| 5,454,914 | A | 10/1995 | Gay |
| 5,531,868 | A | 7/1996 | Miller et al. |
| 5,582,706 | A | 12/1996 | Grantham et al. |
| 5,689,538 | A | 11/1997 | Bonhomme |
| 5,770,034 | A | 6/1998 | Jansen et al. |
| 5,935,394 | A | 8/1999 | Sivilotti et al. |
| 6,142,291 | A | 11/2000 | Schulze et al. |
| 6,540,902 | B1 | 4/2003 | Redey et al. |
| 6,689,260 | B1 | 2/2004 | Ahluwalia et al. |
| 6,821,405 | B1 | 11/2004 | Marttila |
| 6,866,768 | B2 | 3/2005 | Bradford et al. |
| 7,011,736 | B1 | 3/2006 | Miller et al. |
| 7,090,760 | B2 | 8/2006 | Seo et al. |
| 7,097,747 | B1 | 8/2006 | Herceg et al. |
| 7,449,635 | B2 | 11/2008 | Wiant |
| 7,563,982 | B2 | 7/2009 | Kimmel |
| 7,638,026 | B1 | 12/2009 | Willit et al. |
| 7,799,185 | B1 | 9/2010 | Willit |
| 2004/0007466 | A1 | 1/2004 | Seo et al. |
| 2004/0134785 | A1 | 7/2004 | Gay et al. |
| 2004/0168932 | A1 | 9/2004 | Wang |
| 2005/0067291 | A1 | 3/2005 | Haiki et al. |
| 2005/0205428 | A1 | 9/2005 | Dees et al. |
| 2005/0233634 | A1 | 10/2005 | Kollmann |
| 2006/0067291 | A1 | 3/2006 | Nakata |
| 2007/0082551 | A1 | 4/2007 | Oesterhaus |
| 2007/0295601 | A1 | 12/2007 | Bayer |
| 2008/0128270 | A1 | 6/2008 | Hiraiwa et al. |
| 2008/0142374 | A1 | 6/2008 | Iwama et al. |
| 2008/0152270 | A1 | 6/2008 | Engesser et al. |
| 2009/0050483 | A1 | 2/2009 | Li |
| 2009/0152124 | A1 | 6/2009 | Ashford et al. |
| 2010/0276259 | A1 | 11/2010 | Phalen |
| 2011/0180409 | A1 | 7/2011 | Willit et al. |

FOREIGN PATENT DOCUMENTS

| | | |
|---|---|---|
| DE | 26 00 344 | 7/1977 |
| DE | 3837572 | 5/1989 |
| DE | 198 45 258 C1 | 3/2000 |
| DE | 19845258 C1 * | 3/2000 |
| EP | 0736929 | 10/1996 |
| EP | 2224542 | 9/2010 |
| EP | 0 286 092 | 10/2012 |
| GB | 284678 | 11/1928 |
| GB | 506590 | 5/1939 |
| GB | 516 775 A | 1/1940 |
| JP | H05279887 | 10/1993 |
| JP | H0972991 | 3/1997 |
| JP | 2006-308442 | 11/2006 |
| WO | WO 02/066709 | 8/2002 |
| WO | WO 2004/018737 | 3/2004 |
| WO | WO 2004/031453 | 4/2004 |
| WO | WO 2005/035404 | 4/2005 |
| WO | WO 2006/007863 | 1/2006 |
| WO | WO 2009/062005 | 5/2009 |
| WO | WO 2010/080761 | 7/2010 |

OTHER PUBLICATIONS

International Search Report and Written Opinion issued in International Patent Application No. PCT/US2012/058531, issued Aug. 2, 2013.

European Search Report issued in European Patent Application No. 13163951.0, issued Aug. 29, 2013.

International Search Report and Written Opinion issued in International Patent Application No. PCT/US2012/058664, mailed Jul. 8, 2013.

International Search Report and Written Opinion issued in International Patent Application No. PCT/US2012/058659, mailed Jul. 5, 2013.

International Search Report and Written Opinion issued in International Patent Application No. PCT/US2012/058661, mailed Jul. 25, 2013.

Figueroa, J. et al., "GTRI Progress in Developing Pyrochemical Processes for Recovery of Fabrication Scrap and Reprocessing of Monolithic U-MO Fuel", RERTR 2011—International Meeting on Reduced Enrichment for Research and Test Reactors, Oct. 23, 2011, XP055071122.

International Search Report dated May 11, 2012 issued in PCT/US2011/005871.

Jeong, et al., "Electrolytic production of metallic Uranium from $U_3O_8$ in a 20-kg batch scale reactor", Journal of Radioanalytical and Nuclear Chemistry, vol. 268, No. 2, pp. 349-356 (2006).

International Search Report issued in connection with WO Patent Application No. PCT/US2011/053589, Jan. 20, 2012.

"Proceedings of Global 2005", Tsukuba, Japan, Oct 9-13, 2005, Paper No. 488.

International Search Report dated Jan. 30, 2012 issued in PCT/US2011/053878.

International Search Report dated Feb. 6, 2012 issued in PCT/US2011/053872.

Steven D. Herrman, et al., "Electrolytic Reduction of Spent Oxide Fuel—Bench-Scale Test Results", Global 2005, INL/CON-05-00304, Paper No. 488, Oct. 2005.

* cited by examiner

500

ANODE SHROUD FOR OFF-GAS CAPTURE AND REMOVAL FROM ELECTROLYTIC OXIDE REDUCTION SYSTEM

FEDERALLY SPONSORED RESEARCH OR DEVELOPMENT

The present invention was made with Government support under contract number DE-ACO2-06CH11357, which was awarded by the U.S. Department of Energy.

BACKGROUND

1. Field

The present invention relates to an anode shroud for an electrolytic oxide reduction system.

2. Description of Related Art

An electrochemical process may be used to recover metals from an impure feed and/or to extract metals from a metal-oxide. A conventional process typically involves dissolving a metal-oxide in an electrolyte followed by electrolytic decomposition or selective electrotransport to reduce the metal-oxide to its corresponding metal. Conventional electrochemical processes for reducing metal-oxides to their corresponding metallic state may employ a single step or multiple-step approach.

A multiple-step approach is typically used when a metal-oxide has a relatively low solubility in the electrolyte. The multiple-step approach may be a two-step process that utilizes two separate vessels. For example, the extraction of uranium from the uranium oxide of spent nuclear fuels includes an initial step of reducing the uranium oxide with lithium dissolved in a molten LiCl electrolyte so as to produce uranium and $Li_2O$ in a first vessel, wherein the $Li_2O$ remains dissolved in the molten LiCl electrolyte. The process then involves a subsequent step of electrowinning in a second vessel, wherein the dissolved $Li_2O$ in the molten LiCl is electrolytically decomposed to regenerate lithium. Consequently, the resulting uranium may be extracted, while the molten LiCl with the regenerated lithium may be recycled for use in the reduction step of another batch.

However, a multi-step approach involves a number of engineering complexities, such as issues pertaining to the transfer of molten salt and reductant at high temperatures from one vessel to another. Furthermore, the reduction of oxides in molten salts may be thermodynamically constrained depending on the electrolyte-reductant system. In particular, this thermodynamic constraint will limit the amount of oxides that can be reduced in a given batch. As a result, more frequent transfers of molten electrolyte and reductant will be needed to meet production requirements.

On the other hand, a single-step approach generally involves immersing a metal oxide in a compatible molten electrolyte together with a cathode and anode. By charging the anode and cathode, the metal oxide can be reduced to its corresponding metal through electrolytic conversion and ion exchange through the molten electrolyte. However, although a conventional single-step approach may be less complex than a multi-step approach, the metal yield is still relatively low. Furthermore, reducing a metal oxide to its corresponding metal will result in the production of oxygen gas, which is corrosive and, thus, detrimental to the system if not properly addressed.

SUMMARY

An anode shroud may be provided for each anode assembly of an electrolytic oxide reduction system to dilute, cool, and/or remove off-gas from the electrolytic oxide reduction system. An anode shroud according to a non-limiting embodiment of the present invention may include a body portion having a tapered upper section that includes an apex. The upper section may slope downwards from the apex. The body portion may have an inner wall that defines an off-gas collection cavity. An underside of the body portion may be unenclosed. A plurality of anode guides may be disposed on opposing slopes of the upper section of the body portion. Each of the plurality of anode guides may define a passage that leads to the off-gas collection cavity within the body portion. A chimney structure may extend from the apex of the upper section and be connected to the off-gas collection cavity of the body portion. The chimney structure may include an inner tube within an outer tube. Accordingly, a sweep gas/cooling gas may be supplied down the annular space between the inner and outer tubes, while the off-gas may be removed through an exit path defined by the inner tube.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION

Figure 1:
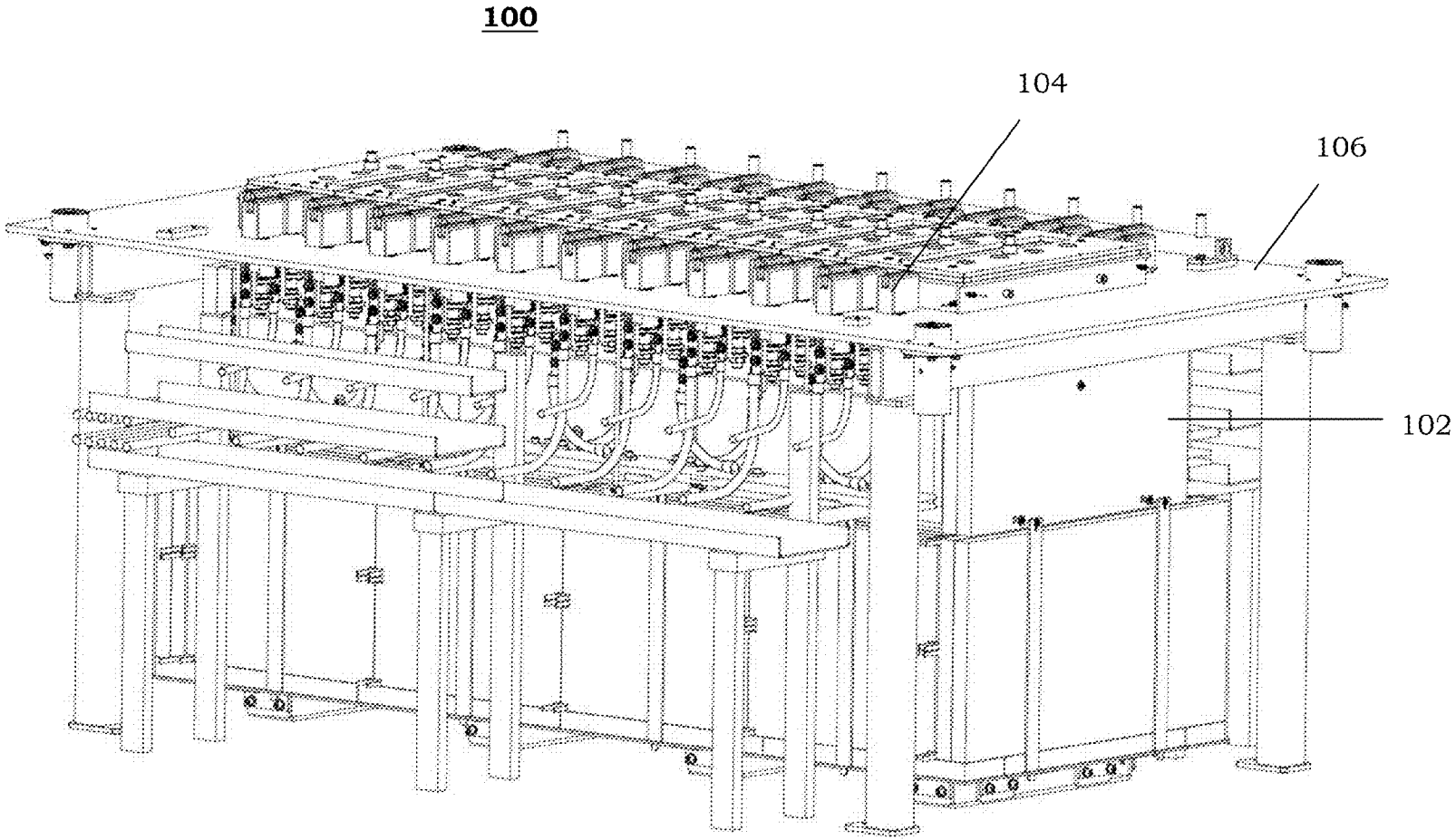
FIG. 1 is a perspective view of an electrolytic oxide reduction system according to a non-limiting embodiment of the present invention.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It should be understood that, although the terms first, second, third, etc. may be used herein to describe various elements, components, regions, layers and/or sections, these elements, components, regions, layers, and/or sections should not be limited by these terms. These terms are only used to distinguish one element, component, region, layer, or section from another region, layer, or section. Thus, a first element, component, region, layer, or section discussed below could be termed a second element, component, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of example embodiments.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

An electrolytic oxide reduction system according to a non-limiting embodiment of the present invention is configured to facilitate the reduction of an oxide to its metallic form so as to permit the subsequent recovery of the metal. Generally, the electrolytic oxide reduction system includes a plurality of anode assemblies, an anode shroud for each of the plurality of anode assemblies, a plurality of cathode assemblies, and a power distribution system for the plurality of anode and cathode assemblies. However, it should be understood that the electrolytic oxide reduction system is not limited thereto and may include other components that may not have been specifically identified herein.

In addition to the disclosure herein, the electrolytic oxide reduction system may be as described in related U.S. application Ser. No. 12/978,027; filed on even date herewith; entitled "ELECTROLYTIC OXIDE REDUCTION SYSTEM," the power distribution system may be as described in related U.S. application Ser. No. 12/977,839; filed on even date herewith; entitled "ANODE-CATHODE POWER DISTRIBUTION SYSTEMS AND METHODS OF USING THE SAME FOR ELECTROCHEMICAL REDUCTION," the anode assembly may be as described in related U.S. application Ser. No. 12/977,916; filed on even date herewith; entitled "MODULAR ANODE ASSEMBLIES AND METHODS OF USING THE SAME FOR ELECTROCHEMICAL REDUCTION," and the cathode assembly may be as described in related U.S. application Ser. No. 12/978,005; filed on even date herewith; entitled "MODULAR CATHODE ASSEMBLIES AND METHODS OF USING THE SAME FOR ELECTROCHEMICAL REDUCTION," the entire contents of each of which are hereby incorporated by reference. A table of the incorporated applications is provided below.

Related Applications Incorporated by Reference

| U.S. application Ser. No. | HDP/GE Ref. | Filing Date | Title |
|---|---|---|---|
| 12/978,027 | 8564-000228/US 24AR246140 | Filed on even date herewith | ELECTROLYTIC OXIDE REDUCTION SYSTEM |
| 12/977,839 | 8564-000225/US 24AR246136 | Filed on even date herewith | ANODE-CATHODE POWER DISTRIBUTION SYSTEMS AND METHODS OF USING THE SAME FOR ELECTROCHEMICAL REDUCTION |
| 12/977,916 | 8564-000226/US 24AR246138 | Filed on even date herewith | MODULAR ANODE ASSEMBLIES AND METHODS OF USING THE SAME FOR ELECTROCHEMICAL REDUCTION |
| 12/978,005 | 8564-000227/US 24AR246139 | Filed on even date herewith | MODULAR CATHODE ASSEMBLIES AND METHODS OF USING THE SAME FOR ELECTROCHEMICAL REDUCTION |

During the operation of the electrolytic oxide reduction system, the plurality of anode and cathode assemblies are immersed in a molten salt electrolyte. The molten salt electrolyte may be maintained at a temperature of about 650° C. (+/−50° C.), although example embodiments are not limited thereto. An electrochemical process is carried out such that a reducing potential is generated at the cathode assemblies, which contain the oxide feed material (e.g., metal oxide). Under the influence of the reducing potential, the oxygen (O) from the metal oxide (MO) feed material dissolves into the molten salt electrolyte as an oxide ion, thereby leaving the metal (M) behind in the cathode assemblies. The cathode reaction may be as follows:

$$MO+2e^{-}\rightarrow M+O^{2-}$$

At the anode assemblies, the oxide ion is converted to oxygen gas. The anode shroud of each of the anode assemblies may be used to dilute, cool, and remove the oxygen gas from the electrolytic oxide reduction system during the process. The anode reaction may be as follows:

$$O^{2-}\rightarrow \tfrac{1}{2}O_2+2e^{-}$$

In a non-limiting embodiment, the metal oxide may be uranium dioxide ($UO_2$), and the reduction product may be uranium metal. However, it should be understood that other types of oxides may also be reduced to their corresponding metals with the electrolytic oxide reduction system according to the present invention. Similarly, the molten salt electrolyte used in the electrolytic oxide reduction system according to the present invention is not particularly limited thereto and may vary depending of the oxide feed material to be reduced. Compared to prior art apparatuses, electrolytic oxide reduction system according to the present invention allows for a significantly greater yield of reduction product.

FIG. 1 is a perspective view of an electrolytic oxide reduction system according to a non-limiting embodiment of the present invention. Referring to FIG. 1, the electrolytic oxide reduction system 100 includes a vessel 102 that is designed to hold a molten salt electrolyte. Accordingly, the vessel 102 is formed of a material that can withstand temperatures up to about 700° C. so as to be able to safely hold the molten salt electrolyte. The vessel 102 may be externally heated and provided with longitudinal supports. The vessel 102 may also be configured for zone heating to allow for more efficient operation and recovery from process upsets. During operation of the electrolytic oxide reduction system 100, a plurality of anode and cathode assemblies 200 and 300 (e.g., FIG. 4) are arranged so as to be partially immersed in the molten salt electrolyte in the vessel 102. The anode and cathode assemblies 200 and 300 will be discussed in further detail in connection with FIGS. 2A-2B and 3.

Power is distributed to the anode and cathode assemblies 200 and 300 through the plurality of knife edge contacts 104. The knife edge contacts 104 are arranged in pairs on a glovebox floor 106 that is situated above the vessel 102. Each pair of the knife edge contacts 104 is arranged so as to be on opposite sides of the vessel 102. As shown in FIG. 1, the knife edge contacts 104 are arranged in alternating one-pair and two-pair rows, wherein the end rows consist of one pair of knife edge contacts 104.

The one-pair rows of knife edge contacts 104 are configured to engage the anode assemblies 200, while the two-pair rows are configured to engage the cathode assemblies 300. Stated more clearly, the plurality of knife edge contacts 104 are arranged such that an anode assembly 200 receives power from one power supply via one pair of knife edge contacts 104 (two knife edge contacts 104), while a cathode assembly 300 receives power from two power supplies via two pairs of knife edge contacts 104 (four knife edge contacts 104). With regard to the two pairs of knife edge contacts 104 for the cathode assembly 300, the inner pair may be connected to a low power feedthrough, while the outer pair may be connected to a high power feedthrough (or vice versa).

For instance, assuming the electrolytic oxide reduction system 100 is designed to hold eleven anode assemblies 200 and ten cathode assemblies 300 (although example embodiments are not limited thereto), twenty-two knife edge contacts 104 (11 pairs) will be associated with the eleven anode assemblies, while forty knife edge contacts 104 (20 pairs) will be associated with the ten cathode assemblies 300. As previously noted above, in addition to the disclosure herein, the power distribution system may be as described in related U.S. application Ser. No. 12/977,839; filed on even date herewith; entitled "ANODE-CATHODE POWER DISTRIBUTION SYSTEMS AND METHODS OF USING THE SAME FOR ELECTROCHEMICAL REDUCTION," the entire contents of which is hereby incorporated by reference.

The electrolytic oxide reduction system 100 may additionally include modular heat shields designed to limit heat loss from the vessel 102. The modular heat shields may have instrumentation ports configured to monitor current, voltage, and off-gas composition during process operations. Furthermore, a cooling channel and expansion joint may be disposed between the glovebox floor 106 and the vessel 102. The expansion joint may be C-shaped and made from 18 gauge sheet metal. The cooling channel may be secured beneath the glovebox floor 106 but above the expansion joint. As a result, despite the fact that the vessel 102 may reach temperatures of about 700° C., the cooling channel can remove heat from the expansion joint (which is secured to the top of the vessel 102), thereby keeping the glovebox floor 106 at a temperature of about 80° C. or less.

Figure 2A:
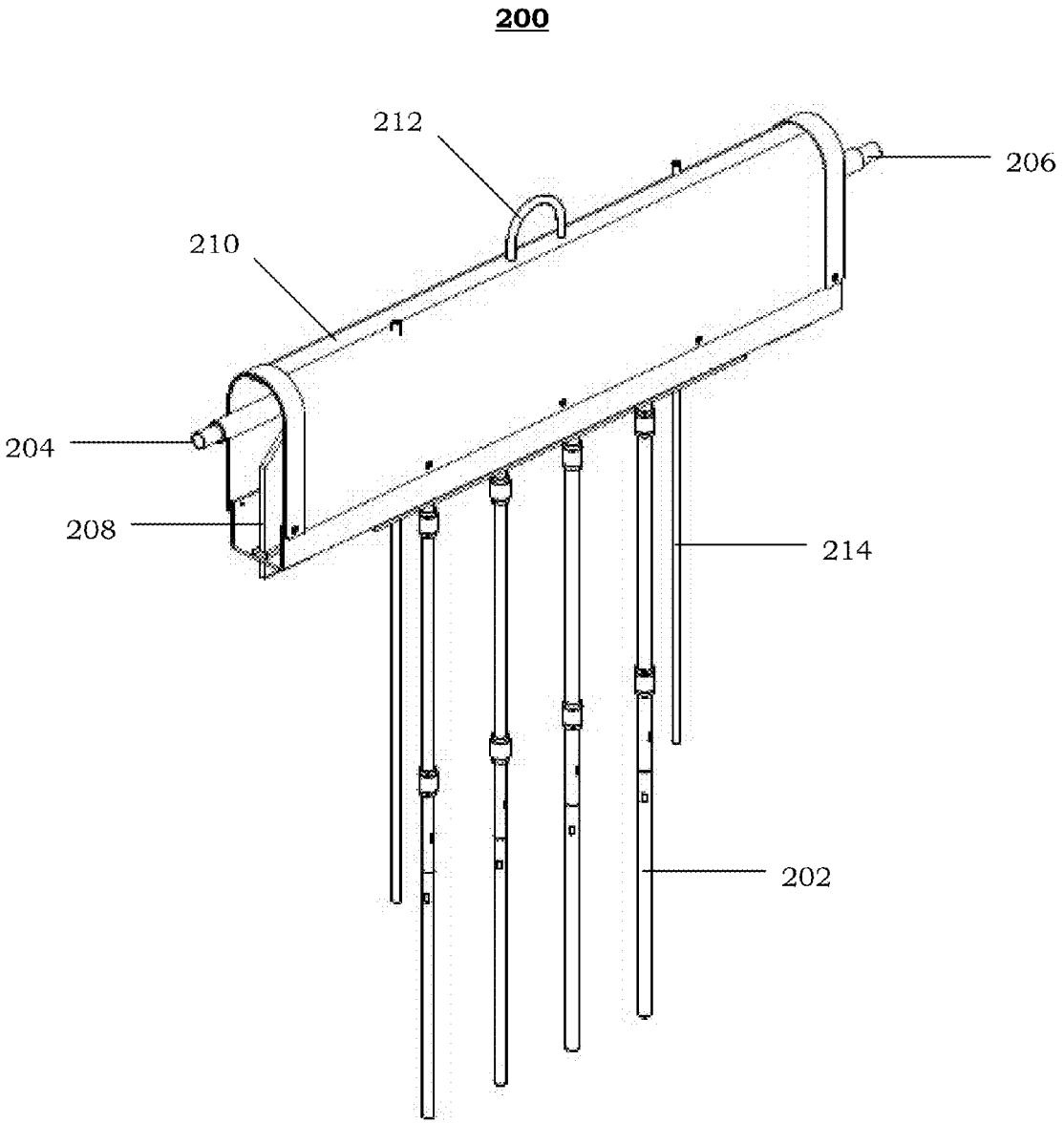
FIGS. 2A-2B are perspective views of an anode assembly for an electrolytic oxide reduction system according to a non-limiting embodiment of the present invention.
Figure 2B:
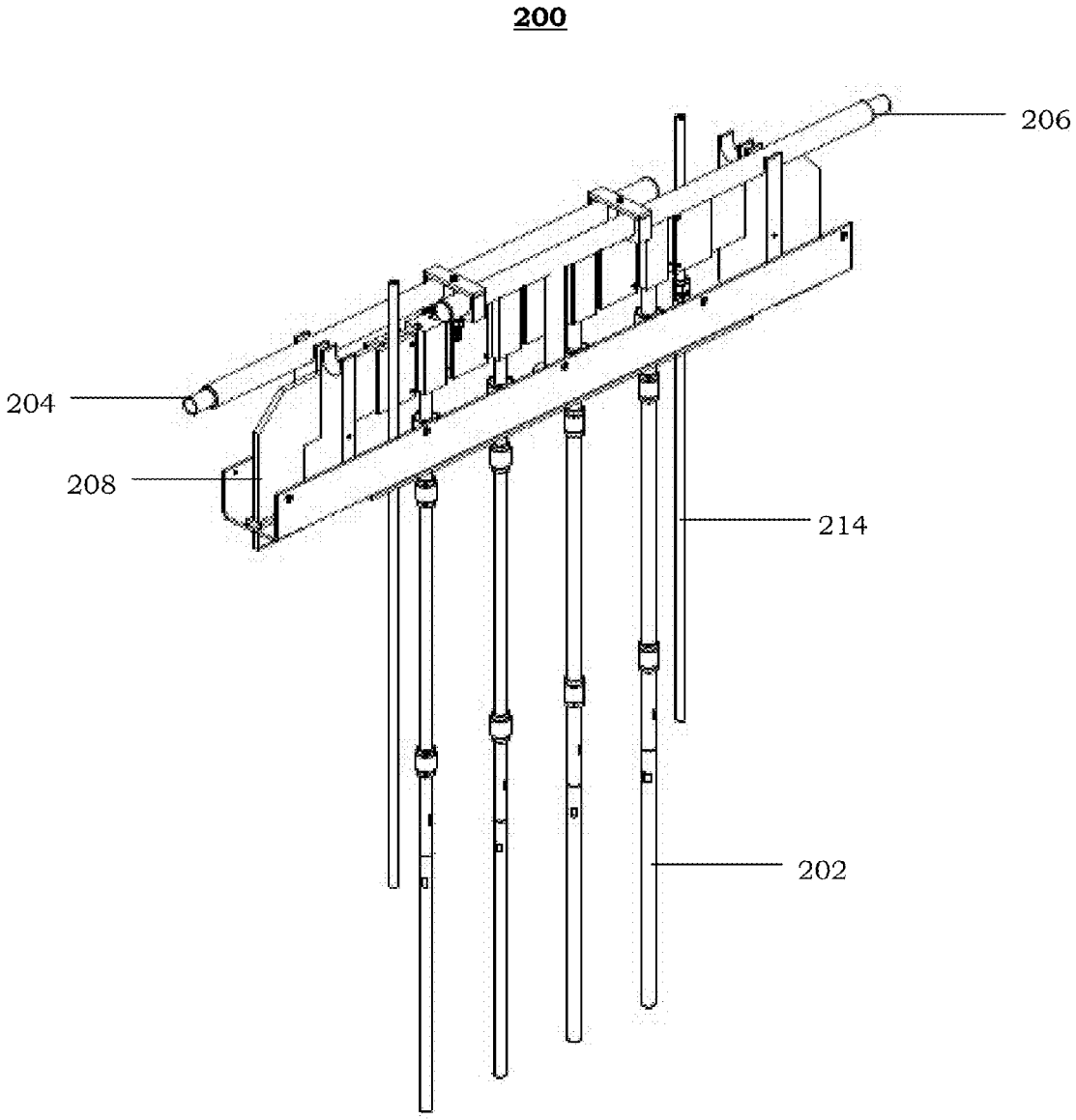

FIGS. 2A-2B are perspective views of an anode assembly for an electrolytic oxide reduction system according to a non-limiting embodiment of the present invention. Referring to FIGS. 2A-2B, the anode assembly 200 includes a plurality of anode rods 202 connected to an anode bus bar 208. The upper and lower portions of each anode rod 202 may be formed of different materials. For instance, the upper portion of the anode rod 202 may be formed of a nickel alloy, and the lower portion of the anode rod 202 may be formed of platinum, although example embodiments are not limited thereto. The lower portion of the anode rod 202 may sit below the molten salt electrolyte level during the operation of the electrolytic oxide reduction system 100 and may be removable to allow the lower portion to be replaced or changed to another material.

The anode bus bar 208 may be segmented to reduce thermal expansion, wherein each segment of the anode bus bar 208 may be formed of copper. The segments of the anode bus bar 208 may be joined with a slip connector. Additionally, the slip connector may attach to the top of an anode rod 202 to ensure that the anode rod 202 will not fall into the molten salt electrolyte. The anode assembly 200 is not to be limited by any of the above examples. Rather, it should be understood that other suitable configurations and materials may also be used.

When the anode assembly 200 is lowered into the electrolytic oxide reduction system 100, the lower end portions of the anode bus bar 208 will engage the corresponding pair of knife edge contacts 104, and the anode rods 202 will extend into the molten salt electrolyte in the vessel 102. Although four anode rods 202 are shown in FIGS. 2A-2B, it should be understood that example embodiments are not limited thereto. Thus, the anode assembly 200 may include less than four anode rods 202 or more than four anode rods 202, provided that sufficient anodic current is being provided to the electrolytic oxide reduction system 100.

During operation of the electrolytic oxide reduction system 100, the anode assembly 200 may be kept to a temperature of about 150° C. or less. To maintain the appropriate operating temperature, the anode assembly 200 includes a cooling line 204 that supplies a cooling gas and an off-gas line 206 that removes the cooling gas supplied by the cooling line 204 as well as the off-gas generated by the reduction process. The cooling gas may be an inert gas (e.g., argon) while the off-gas may include oxygen, although example embodiments are not limited thereto. As a result, the concentration and temperature of the off-gas may be lowered, thereby reducing its corrosiveness. It should also be understood that the cooling gas may also be referred to herein as a "sweep gas."

The cooling gas may be provided by the glovebox atmosphere. In a non-limiting embodiment, no pressurized gases external to the glovebox are used. In such a case, a gas supply can be pressurized using a blower inside the glovebox, and the off-gas exhaust will have an external vacuum source. All motors and controls for operating the gas supply may be located outside the glovebox for easier access and maintenance. To keep the molten salt electrolyte from freezing, the supply process can be configured so that the cooling gas inside the anode shroud will not be lower than about 610° C.

The anode assembly 200 may further include an anode guard 210, a lift bail 212, and instrumentation guide tubes 214. The anode guard 210 provides protection from the anode bus bar 208 and may also provide guidance for the insertion of the cathode assembly 300. The anode guard 210 may be formed of a metal and perforated to allow for heat loss from the top of the anode assembly 200. The lift bail 212 assists in the removal of the anode assembly 200. The instrumentation guide tubes 214 provide a port for the insertion of instrumentation into the molten salt electrolyte and/or gas space beneath the anode assembly 200. As previously noted above, in addition to the disclosure herein, the anode assembly may be as described in related U.S. application Ser. No. 12/977,916; filed on even date herewith; entitled "MODULAR ANODE ASSEMBLIES AND METHODS OF USING THE SAME FOR ELECTROCHEMICAL REDUCTION," the entire contents of which is hereby incorporated by reference.

Figure 3:
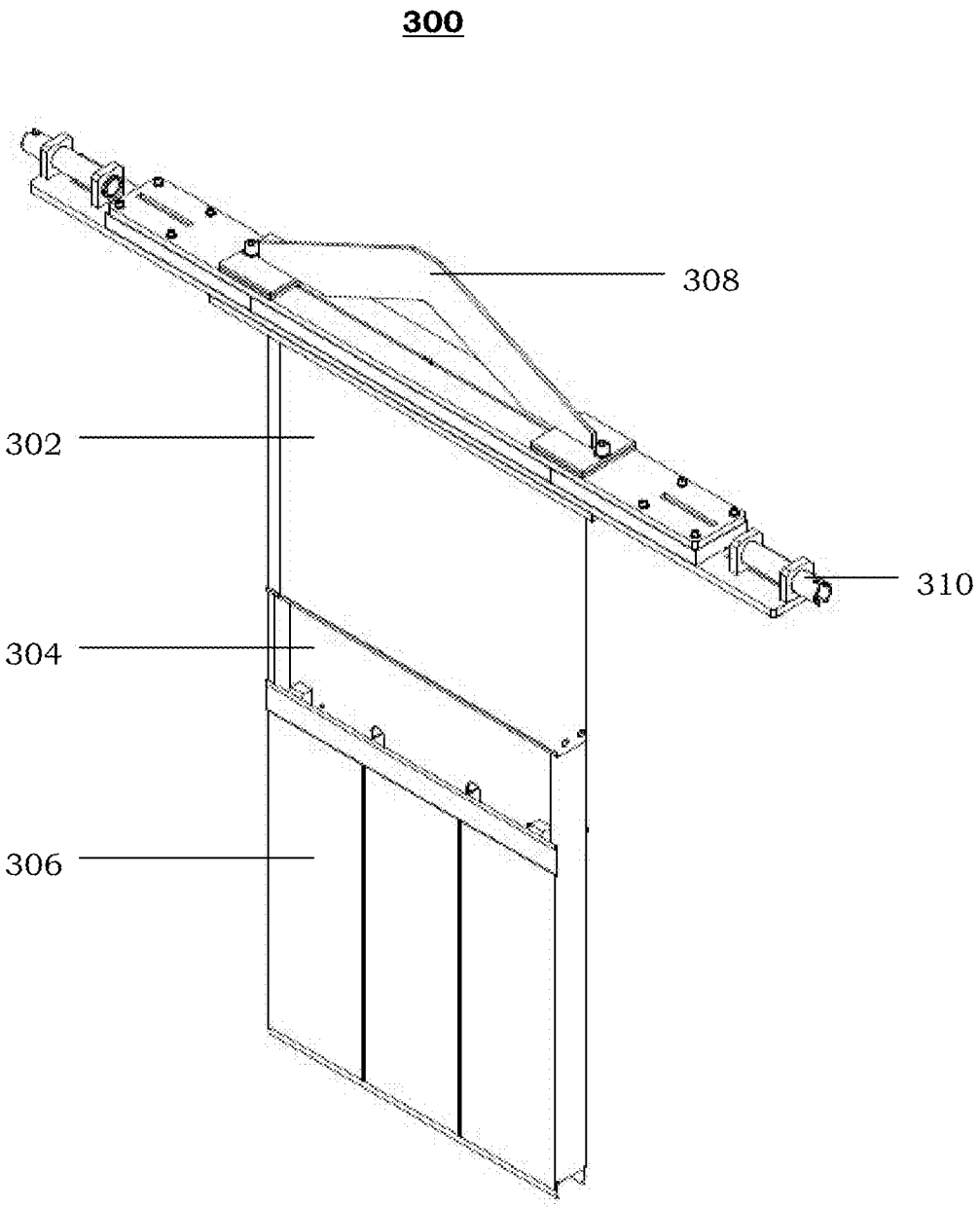
FIG. 3 is a perspective view of a cathode assembly for an electrolytic oxide reduction system according to a non-limiting embodiment of the present invention.

FIG. 3 is a perspective view of a cathode assembly for an electrolytic oxide reduction system according to a non-limiting embodiment of the present invention. Referring to FIG. 3, the cathode assembly 300 is designed to contain the oxide feed material for the reduction process and includes an upper basket 302, a lower basket 306, and a cathode plate 304 housed within the upper and lower baskets 302 and 306. When assembled, the cathode plate 304 will extend from a top end of the upper basket 302 to a bottom end of the lower basket 306. The side edges of the cathode plate 304 may be hemmed to provide rigidity. A reverse bend may also be provided down the center of the cathode plate 304 for added rigidity. The lower basket 306 may be attached to the upper basket 302 with four high strength rivets. In the event of damage to either the lower basket 306 or the upper basket 302, the rivets can be drilled out, the damaged basket replaced, and re-riveted for continued operation.

The cathode basket (which includes the upper basket 302 and the lower basket 306) is electrically isolated from the cathode plate 304. Each cathode assembly 300 is configured to engage two pairs of knife edge contacts 104 (four knife edge contacts 104) so as to receive power from two power supplies. For instance, the cathode plate 304 may receive a primary reduction current, while the cathode basket may receive a secondary current to control various byproducts of the reduction process. The cathode basket may be formed of a porous metal plate that is sufficiently open to allow molten salt electrolyte to enter and exit during the reduction process yet fine enough to retain the oxide feed material and resulting metallic product.

Stiffening ribs may be provided inside the cathode basket to reduce or prevent distortion. Where vertical stiffening ribs are provided in the lower basket 306, the cathode plate 304 will have corresponding slots to allow clearance around the stiffening ribs when the cathode plate 304 is inserted into the cathode basket. For instance, if the lower basket 306 is provided with two vertical stiffening ribs, then the cathode plate 304 will have two corresponding slots to allow clearance around the two stiffening ribs. Additionally, position spacers may be provided near the midsection of both faces of the cathode plate 304 to ensure that the cathode plate 304 will remain in the center of the cathode basket when loading the oxide feed material. The position spacers may be ceramic and vertically-oriented. Furthermore, staggered spacers may be provided on the upper section of both faces of the cathode plate 304 to provide a thermal break for radiant and conductive heat transfer to the top of the cathode assembly 300. The staggered spacers may be ceramic and horizontally-oriented.

The cathode assembly 300 may also include a lift bracket 308 with lift tabs 310 disposed on the ends. The lift tabs 310 are designed to interface with a lift system of the electrolytic oxide reduction system 100. As previously noted above, in addition to the disclosure herein, the cathode assembly may be as described in related U.S. application Ser. No. 12/978,005; filed on even date herewith; entitled "MODULAR CATHODE ASSEMBLIES AND METHODS OF USING THE SAME FOR ELECTROCHEMICAL REDUCTION," the entire contents of which is hereby incorporated by reference.

Figure 4:
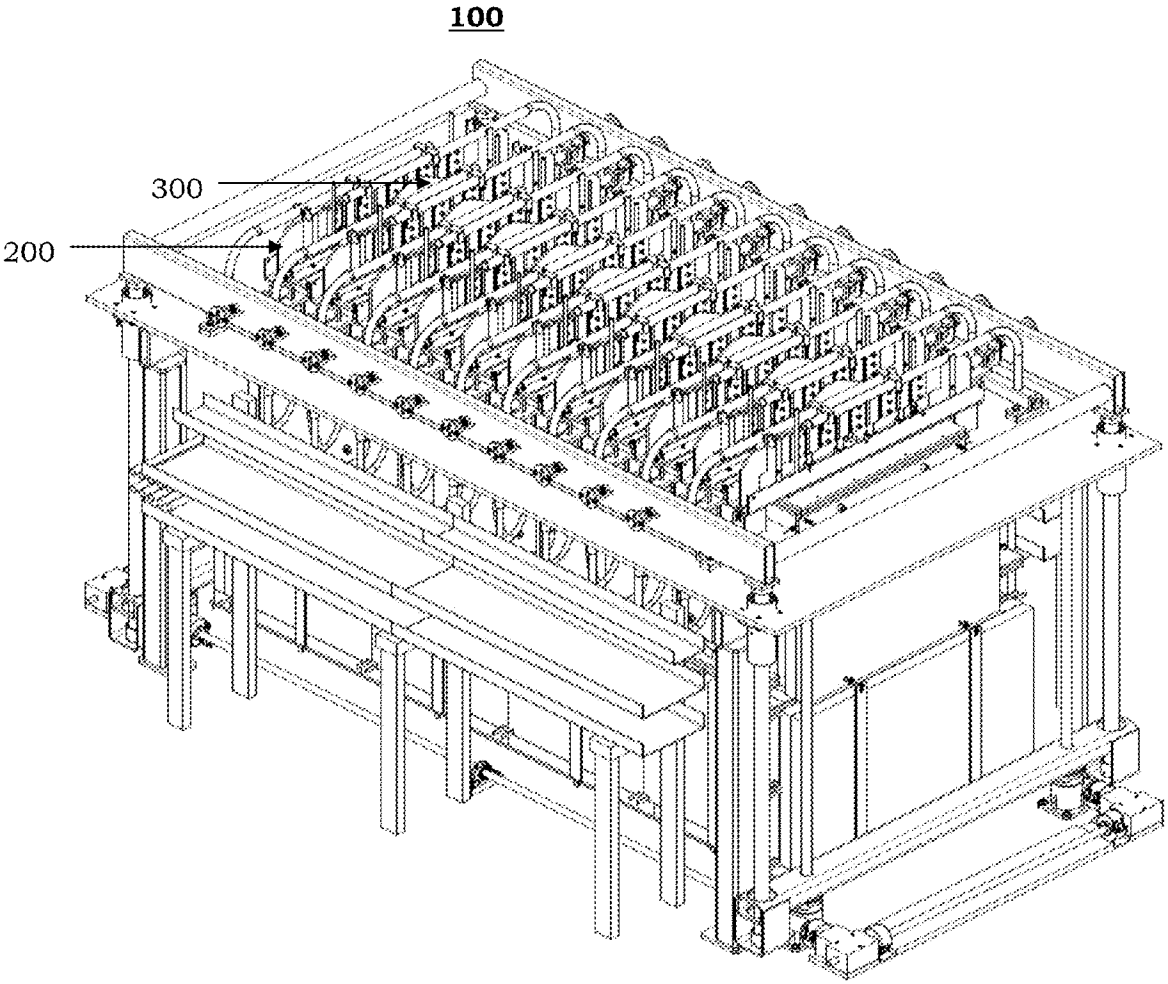
FIG. 4 is a perspective view of an electrolytic oxide reduction system with the anode and cathode assemblies as well as a lift system that is in a lowered position according to a non-limiting embodiment of the present invention.

FIG. 4 is a perspective view of an electrolytic oxide reduction system with the anode and cathode assemblies as well as a lift system that is in a lowered position according to a non-limiting embodiment of the present invention. The lift system may be as described in related U.S. application Ser. No. 12/978,027; filed on even date herewith; entitled "ELECTROLYTIC OXIDE REDUCTION SYSTEM," the entire contents of which is hereby incorporated by reference. In addition to the lift system, FIG. 4 also illustrates the plurality of anode and cathode assemblies 200 and 300 as arranged in the electrolytic oxide reduction system 100 during operation. The anode and cathode assemblies 200 and 300 may be alternately arranged such that each cathode assembly 300 is flanked by two anode assemblies 200. Although the electrolytic oxide reduction system 100 in FIG. 4 is illustrated as having eleven anode assemblies 200 and ten cathode assemblies, it should be understood that example embodiments are not limited thereto. Instead, the modular design of the electrolytic oxide reduction system 100 allows for the inclusion of more or less anode and cathode assemblies.

As previously noted, an anode shroud (which will be discussed in further detail below in connection with FIGS. 5A-5C and 6) may be provided for each anode assembly in the electrolytic oxide reduction system. Thus, if the electrolytic oxide reduction system includes eleven anode assemblies, then eleven anode shrouds will also be included (although example embodiments are not limited thereto). The anode shrouds facilitate the cooling of the anode assembly 200 as well as the removal of the off-gas generated by the reduction process. For instance, the anode shroud of each of the anode assemblies may be used to dilute, cool, and remove the oxygen gas from the electrolytic oxide reduction system during the reduction of uranium oxide to uranium metal.

Figure 5A:
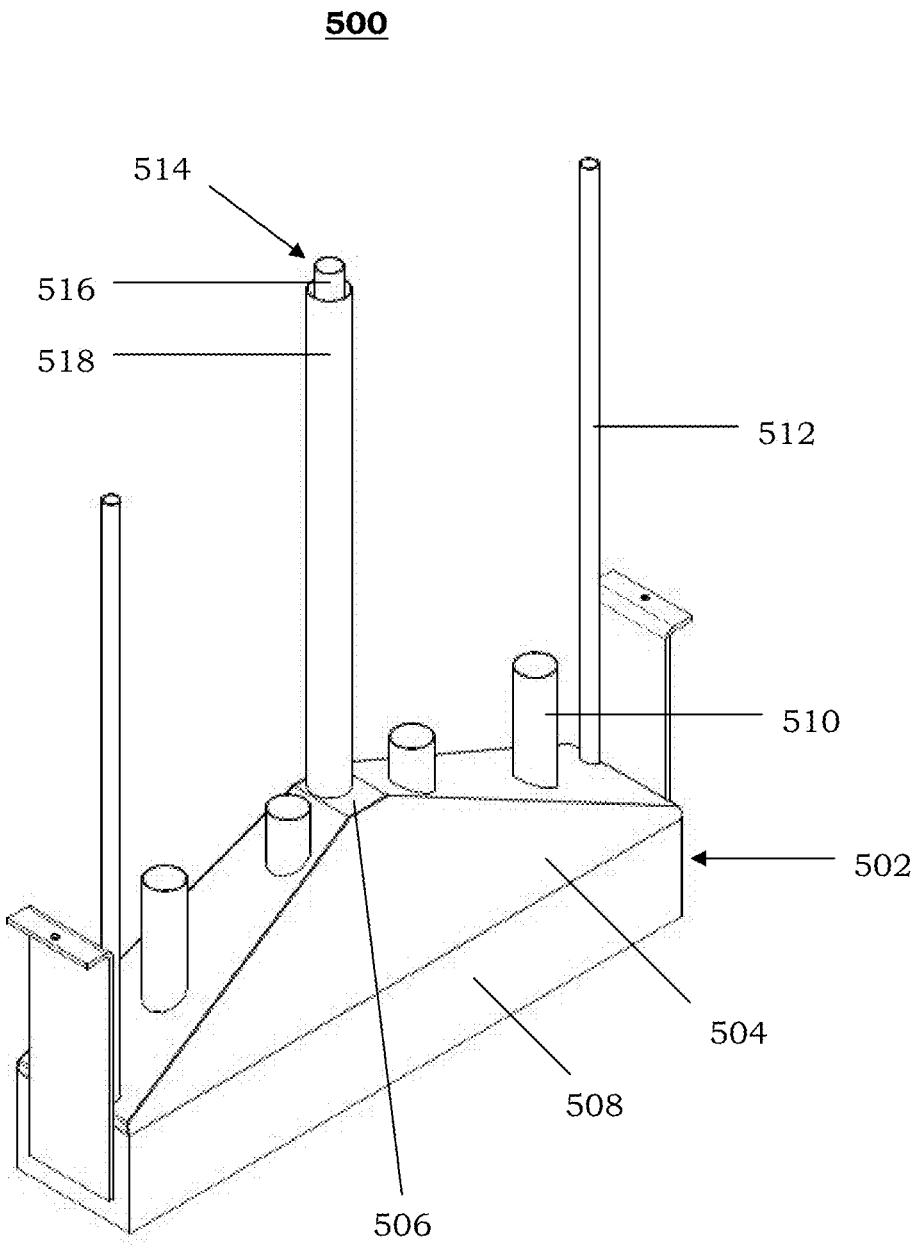
FIG. 5A is a perspective view of an anode shroud for an electrolytic oxide reduction system according to a non-limiting embodiment of the present invention.

FIG. 5A is a perspective view of an anode shroud for an electrolytic oxide reduction system according to a non-limiting embodiment of the present invention. Referring to FIG. 5A, the anode shroud 500 includes a body portion 502 with an upper section 504 and a lower section 508. The lower section 508 may directly adjoin the upper section 504 and have vertical sidewalls. The upper section 504 is tapered and includes an apex 506. The apex 506 of the upper section 504 is centrally positioned relative to a plan view of the body portion 502. The upper section 504 slopes downwards from the apex 506 to the lower section 508. The upper section 504 may slope at an angle ranging from about 25 to 75 degrees relative to a horizontal reference line. For instance, the upper section 504 may slope at a 50 degree angle relative to a horizontal reference line, although example embodiments are not limited thereto.

A plurality of anode guides 510 are disposed on opposing slopes of the upper section 504 of the body portion 502. The anode guides 510 are designed to receive the anode rods 202 of an anode assembly 200 and, thus, may be spaced accordingly. In a non-limiting embodiment, the plurality of anode guides 510 may be uniformly spaced apart from each other. Although FIG. 5A illustrates the anode shroud 500 as having four anode guides 510, it should be understood that the number of anode guides 510 will vary with the number of anode rods 202 of the anode assembly 200 corresponding to the anode shroud 500. For instance, if an anode assembly 200 has six anode rods 202, then the corresponding anode shroud 500 will have six anode guides 510 to receive the six anode rods 202.

Figure 5B:
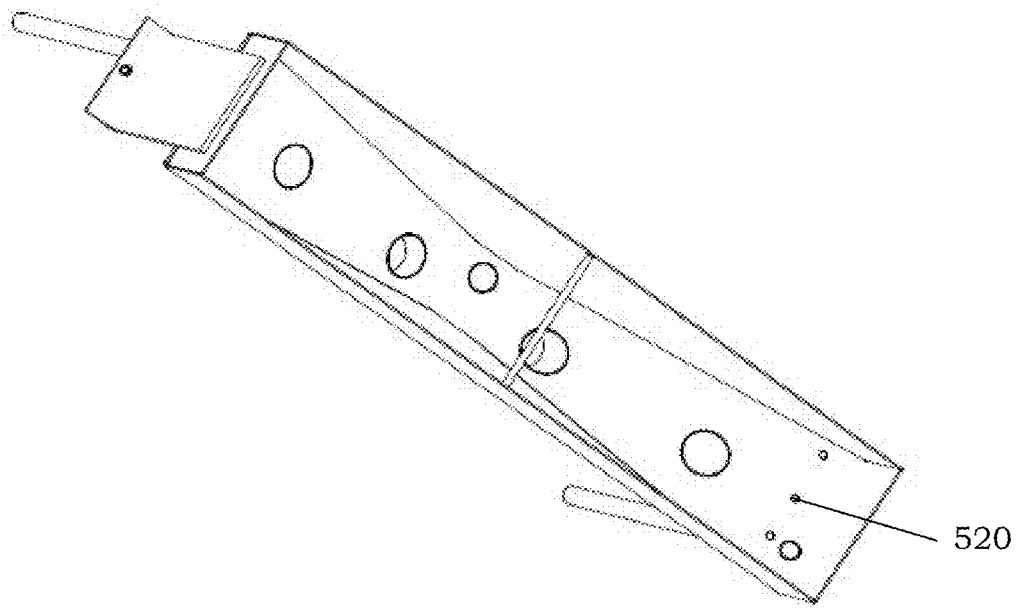
FIG. 5B is a bottom view of an anode shroud for an electrolytic oxide reduction system according to a non-limiting embodiment of the present invention.

Each of the plurality of anode guides 510 defines a passage that leads to the off-gas collection cavity 530 (FIG. 6) within the body portion 502. An inner wall of the body portion 502 defines the off-gas collection cavity 530. The underside of the body portion 502 is unenclosed (FIG. 5B). The anode shroud 500 is designed to be arranged within the electrolytic oxide reduction system 100 such that the bottom edge of the body portion 502 will be submerged in the molten salt electrolyte during the reduction process. In such a case, the off-gas collection cavity 530 within the body portion 502 will be bounded from underneath by the molten salt electrolyte. Furthermore, the anode rods 202 of an anode assembly 200 will extend through the anode guides 510 of the anode shroud 500 into the off-gas collection cavity 530 therein and into the molten salt electrolyte in the vessel 102 of the electrolytic oxide reduction system 100.

A chimney structure 514 extends from the apex 506 of the upper section 504 and is connected to the off-gas collection cavity 530 of the body portion 502. The chimney structure 514 includes an inner tube 516 within an outer tube 518. The inner tube 516 may have a diameter ranging from about 0.5 to 1.5 inches, while the outer tube 518 may have a diameter ranging from about 0.6 to 2.0 inches. That being said, the inner tube 516 may be spaced apart from the outer tube 518 by a distance ranging from about 0.05 to 0.25 inches. In a non-limiting embodiment, the inner tube 516 and outer tube 518 may be concentrically arranged. The chimney structure 514 is configured such that the inner tube 516 provides an exit path for the sweep gas and off-gas.

The chimney structure 514 may be flanked by an equal number of anode guides 510. However, it should be understood that, in the event that an odd number of anode guides 510 are provided, the chimney structure 514 will be flanked by an unequal number of anode guides 510. For instance, if five anode guides 510 are provided, then the chimney structure 514 may be flanked on one side by three anode guides 510 and flanked on the other side by two anode guides 510.

The uppermost surfaces of the plurality of anode guides 510 may be level with each other. Additionally, the uppermost surface of each of the plurality of anode guides 510 may be higher than that of the apex 506 of the upper section 504 but lower than that of the chimney structure 514. Furthermore, the instrument port guides 512 illustrated in FIG. 5A may correspond to the instrumentation guide tubes 214 of the anode assembly 200.

An outer surface of the inner tube 516 and an inner surface of the outer tube 518 define an annular space 526 (FIG. 6) that leads to the off-gas collection cavity 530 in the body portion 502. The chimney structure 514 is configured such that the annular space 526 provides an entrance path for cooling gas/sweep gas to flow down into the off-gas collection cavity 530 of the body portion 502 to dilute, cool, and remove off-gas from the off-gas collection cavity 530.

The body portion 502 may include one or more internal channels 528 (FIG. 6) extending beneath one or more slopes of the upper section 504 from the apex 506 to a base of the upper section 504. In a non-limiting embodiment, an internal channel 528 may extend beneath each slope of the upper section 504. The internal channels 528 are connected to the annular space 526.

The inner tube 516 may include weep holes extending from its outer surface to its inner surface. The weep holes provide a shortcut from the annular space 526 to the exit path defined by the inner surface of the inner tube 516. As a result, when a sweep gas travels down the annular space 526, a minority portion of the sweep gas may be diverted via the weep holes into the exit path defined by the inner tube 516, while the bulk of the sweep gas will continue to the internal channels 528 and down into the off-gas collection cavity 530 before moving upwards with the off-gas through the exit path defined by the inner tube 516. The sweep gas that is diverted by the weep holes may help dilute and cool the off-gas that is being removed from the off-gas collection cavity 530 through the exit path defined by the inner tube 516. The number, arrangement, and size of the weep holes in the inner tube 516 may vary. For instance, a plurality of weep holes may be provided in one or more ring patterns around the circumference of the inner tube 516. The ring patterns may be grouped together or spaced apart by a predetermined interval. Furthermore, the weep holes may be provided at the upper, middle, and/or lower portion of the inner tube 516. A diameter of each of the weep holes may be in the range of about 0.05 to 0.25 inches. In a non-limiting embodiment, each of the weep holes may have a diameter of about 0.15 inches.

The anode shroud 500 is formed of an alloy that is relatively resistant to the corrosion that may occur during an electrolytic oxide reduction process. The alloy may be a Ni—Cr—Al—Fe alloy. For instance, the Ni—Cr—Al—Fe alloy may include about 75% Ni by weight, 16% Cr by weight, 4.5% Al by weight, and 3% Fe by weight. However, it should be understood that other types of corrosion-resistant alloys that can withstand the relatively high temperature of the molten salt electrolyte may also be used.

FIG. 5B is a bottom view of an anode shroud for an electrolytic oxide reduction system according to a non-limiting embodiment of the present invention. Referring to FIG. 5B, the internal channels 528 (FIG. 6) are connected to the off-gas collection cavity 530 through one or more port holes 520 at the base of the upper section 504. Although the port holes 520 are only explicitly shown on the right underside of the anode shroud 500, it should be understood that port holes 520 are also provided on the left underside of the anode shroud 500 and have merely been hidden from view based on the angle of the illustration. Additionally, while three port holes 520 are shown in FIG. 5B, it should be understood that example embodiments are not limited thereto. For instance, the anode shroud 500 may be provided with four or more (or two or less) port holes at each of the right and left undersides of the anode shroud 500.

Figure 5C:
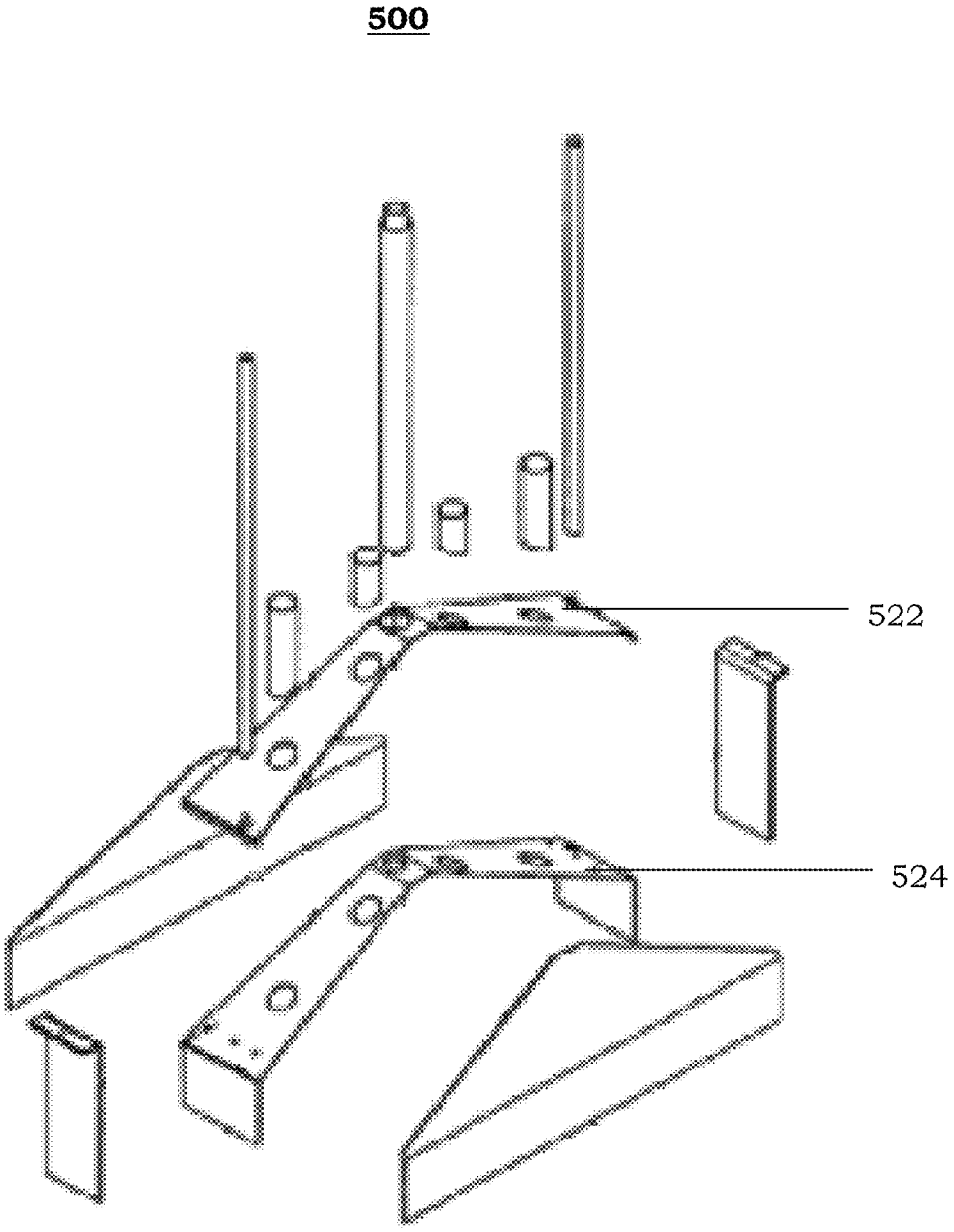
FIG. 5C is an exploded view of an anode shroud for an electrolytic oxide reduction system according to a non-limiting embodiment of the present invention.
Figure 6:
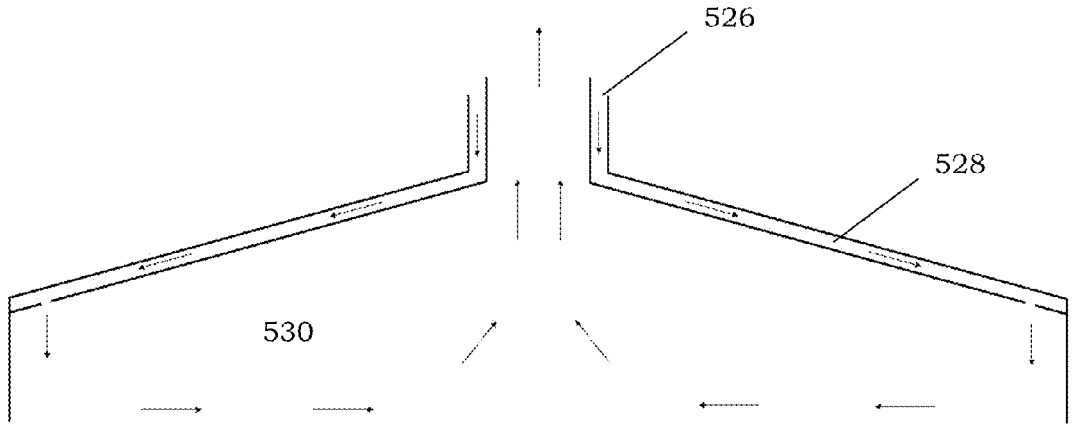
FIG. 6 is a cross-sectional view illustrating the flow of sweep gas and off-gas in an anode shroud for an electrolytic oxide reduction system according to a non-limiting embodiment of the present invention.

FIG. 5C is an exploded view of an anode shroud for an electrolytic oxide reduction system according to a non-limiting embodiment of the present invention. This exploded view is intended to clarify the nature of the internal channels 528 (FIG. 6). Referring to FIG. 5C, the internal channels 528 are defined by an upper body plate 522 and a lower body plate 524. During assembly, the outer tube 518 of the chimney structure 514 (FIG. 5A) will be secured to the upper body plate 522, while the inner tube 516 of the chimney structure 514 will be secured to the lower body plate 524. Additionally, the upper and lower body plates 522 and 524 will be adequately spaced apart from each other during the assembly to provide the internal channels 528.

FIG. 6 is a cross-sectional view illustrating the flow of sweep gas and off-gas in an anode shroud for an electrolytic oxide reduction system according to a non-limiting embodiment of the present invention. As previously discussed, during the process of reducing of an oxide feed material to its corresponding metal, oxygen gas is formed as an off-gas at the anode assemblies 200 of the electrolytic oxide reduction system 100. The anode shroud 500 is used to collect the oxygen off-gas from the anode assembly 200 and remove it from the electrolytic oxide reduction system 100. Because oxygen gas is corrosive, it should be diluted, cooled, and removed as soon as possible without freezing the molten salt electrolyte in the anode shroud 500. By diluting and lowering the temperature of the off-gas, the corrosiveness of the oxygen gas may be decreased.

Referring to FIG. 6, the sweep gas supplied to the chimney structure 514 of the anode shroud 500 initially travels down the annular space 526 between the outer tube 518 and the inner tube 516. As the sweep gas travels down the annular space 526, it encounters weep holes (not shown) in the inner tube 516. The weep holes allow a minority portion of the sweep gas to enter the inner tube 516 to mix with the upwardly moving off-gas, thereby decreasing the concentration and temperature of the off-gas being removed. The bulk of the sweep gas continues down the annular space 526 and increases in temperature as it nears the body portion 502. From the annular space 526, the sweep gas will travel down the internal channels 528 and enter the off-gas collection cavity 530 through the port holes 520 (FIG. 5B). As a result, the off-gas will be swept from the off-gas collection cavity 530 and directed upwards into the exit path defined by the inner tube 516 of the chimney structure 514 for subsequent removal from the electrolytic oxide reduction system 100. Because the sweep gas is heated during its travel to the off-gas collection cavity 530, the freezing of the molten salt electrolyte may be prevented. Furthermore, as discussed above, the exiting off-gas may be diluted and cooled by the downwardly moving sweep gas in the annular space 526 via weep holes in the inner tube 516.

While a number of example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

The invention claimed is:

1. An anode shroud comprising:

a body portion having a tapered upper section that includes an apex, the upper section sloping downwards from the apex, the body portion having an inner wall that defines an off-gas collection cavity, an underside of the body portion being unenclosed;

a plurality of anode guides on opposing slopes of the upper section of the body portion, each of the plurality of anode guides defining a passage that leads to the off-gas collection cavity within the body portion; and a chimney structure extending from the apex of the upper section and connected to the off-gas collection cavity of the body portion, the chimney structure including an inner tube within an outer tube, an end of the inner tube connected to the inner wall of the body portion, and an end of the outer tube connected to an outer wall of the upper section.

2. The anode shroud of claim 1, wherein the apex of the upper section is centrally positioned relative to a plan view of the body portion.

3. The anode shroud of claim 1, wherein the upper section slopes at an angle ranging from 25 to 75 degrees relative to a horizontal reference line.

4. The anode shroud of claim 1, wherein the plurality of anode guides are uniformly spaced apart from each other.

5. The anode shroud of claim 1, wherein the chimney structure is flanked by an equal number of anode guides.

6. The anode shroud of claim 1, wherein uppermost surfaces of the plurality of anode guides are level with each other.

7. The anode shroud of claim 1, wherein an uppermost surface of each of the plurality of anode guides is higher than that of the apex of the upper section but lower than that of the chimney structure.

8. The anode shroud of claim 1, wherein an outer surface of the inner tube and an inner surface of the outer tube define an annular space that leads to the off-gas collection cavity in the body portion, the chimney structure configured such that the annular space provides an entrance path for sweep gas to flow down into the off-gas collection cavity of the body portion to dilute, cool, and remove off-gas from the off-gas collection cavity.

9. The anode shroud of claim 8, wherein the body portion includes one or more internal channels extending beneath one or more slopes of the upper section from the apex to a base of the upper section.

10. The anode shroud of claim 9, wherein the one or more internal channels is connected to the annular space.

11. The anode shroud of claim 10, wherein the one or more internal channels is connected to the off-gas collection cavity through one or more port holes at the base of the upper section.

12. The anode shroud of claim 8, wherein the chimney structure is configured such that the inner tube provides an exit path for the sweep gas and off-gas.

13. The anode shroud of claim 1, wherein the inner tube and outer tube are concentrically arranged.

14. The anode shroud of claim 1, wherein the inner tube is spaced apart from the outer tube by a distance ranging from 0.05 to 0.25 inches.

15. The anode shroud of claim 1, wherein the inner tube has a diameter ranging from 0.5 to 1.5 inches, and the outer tube has a diameter ranging from 0.6 to 2.0 inches.

16. The anode shroud of claim 1, wherein the inner tube includes weep holes.

17. The anode shroud of claim 1, wherein the body portion further includes a lower section that adjoins the upper section, the lower section having vertical sidewalls.

18. The anode shroud of claim 1, wherein the anode shroud is formed of an alloy that is resistant to corrosion during an electrolytic oxide reduction process.

19. The anode shroud of claim 18, wherein the alloy is a Ni—Cr—Al—Fe alloy.

20. The anode shroud of claim 19, wherein the Ni—Cr—Al—Fe alloy includes about 75% Ni by weight, 16% Cr by weight, 4.5% Al by weight, and 3% Fe by weight.

* * * * *